US008288668B2

(12) United States Patent
Zanini et al.

(10) Patent No.: US 8,288,668 B2
(45) Date of Patent: Oct. 16, 2012

(54) CAROUSEL FOR SUPPORTING AND WEIGHING CONTAINERS

(75) Inventors: Gianpietro Zanini, Montanara di Curtatone (IT); Marco Baroni, Barbasso di Roncoferraro (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 350 days.

(21) Appl. No.: 12/670,997

(22) PCT Filed: Jul. 30, 2008

(86) PCT No.: PCT/IB2008/002054

§ 371 (c)(1), (2), (4) Date: Jan. 27, 2010

(87) PCT Pub. No.: WO2009/016499

PCT Pub. Date: Feb. 5, 2009

(65) Prior Publication Data

US 2010/0282523 A1 Nov. 11, 2010

(30) Foreign Application Priority Data

Aug. 2, 2007 (IT) ..... BO2007A0549

(51) Int. Cl.

| | |
|---|---|
| ***G01G 15/00*** | (2006.01) |
| ***G01G 21/28*** | (2006.01) |
| ***G01G 3/00*** | (2006.01) |
| ***B67C 3/20*** | (2006.01) |
| ***B65B 1/32*** | (2006.01) |

(52) U.S. Cl. ..... 177/54; 177/238; 141/83; 141/283

(58) Field of Classification Search ..... 141/83, 141/283; 177/54, 238–244

See application file for complete search history.

(56) References Cited

U.S. PATENT DOCUMENTS

| | | | | |
|---|---|---|---|---|
| 4,824,546 | A | 4/1989 | Ohmi | |
| 4,832,092 | A * | 5/1989 | Hirose et al. | 141/1 |
| 6,073,667 | A * | 6/2000 | Graffin | 141/372 |
| 6,399,901 | B1 * | 6/2002 | Nishino et al. | 177/52 |
| 6,644,363 | B2 * | 11/2003 | Sogliani et al. | 141/83 |
| 6,655,421 | B2 * | 12/2003 | Kohashi et al. | 141/83 |
| 7,325,578 | B2 * | 2/2008 | De Antoni Migliorati et al. | 141/83 |
| 2004/0025962 | A1 * | 2/2004 | De Antoni Migliorati et al. | 141/83 |
| 2004/0123917 | A1 * | 7/2004 | Crivellaro et al. | 141/83 |

FOREIGN PATENT DOCUMENTS

| | | |
|---|---|---|
| EP | 1072511 | 1/2001 |
| EP | 1514834 | 3/2005 |
| FR | 2603017 | 2/1988 |
| FR | 2770292 | 4/1999 |

OTHER PUBLICATIONS

Written Opinion and Search Report of the European Searching Authority from counterpart PCT application.

* cited by examiner

*Primary Examiner* — Randy W Gibson

(74) *Attorney, Agent, or Firm* — Timothy J. Klima; Shuttleworth & Ingersoll, PLC

(57) ABSTRACT

A carousel (1) for supporting and weighing containers (2), comprising: a carrier element (6) supporting at least one container (2), rotatable about a respective axis (X) and presenting at least one opening (13) affording access to an enclosure (14) within the selfsame element (6); a plate (15) associated with the underside of the carrier element (6), serving to close the opening (13), and a system (17) for weighing the container (2), installed at least partially within the enclosure (14). The weighing system (17) comprises a load cell (18) associated with the plate (15) and housed in the enclosure (14).

10 Claims, 3 Drawing Sheets

CAROUSEL FOR SUPPORTING AND WEIGHING CONTAINERS

CROSS-REFERENCE TO RELATED APPLICATIONS

This application is the National Phase of International Application PCT/IB2008/002054 filed Jul. 30, 2008 which designated the U.S. and that International Application was published under PCT Article 21(2) in English.

This application claims priority to Italian Patent Application No. BO2007A000549 filed Aug. 2, 2007, and PCT Application No. PCT/IB2008/002054 filed Jul. 30, 2008, which applications are incorporated by reference herein.

TECHNICAL FIELD

The present invention relates to a carousel for supporting and weighing containers.

In particular, the present invention finds application to advantage in the art field of machine units for filling containers with a variety of different substances, typically liquid food products such as milk or fruit juices, and non-food products such as mineral lubricating oils, powders, detergents, etc.

BACKGROUND ART

The prior art embraces units for filling containers with liquid or powder products, equipped with a carousel carrying a plurality of pedestals on which to stand the containers, each associated with a respective dispensing device from which a predetermined quantity of material is dropped into a container placed on the respective pedestal.

The operation of the single dispensing device is governed by respective weighing means coupled to the pedestal and able to sense the weight of the container continuously. At a given moment during the filling step when the weighing means indicate that a predetermined weight has been reached, signifying that the container is full, the dispensing device will interrupt the flow of liquid or powder material, for example by closing a shut-off valve on a feed duct through which the material is dispensed.

As a general rule, weighing means take the form of a dynamometer contained in a respective housing located beneath the pedestal on which the container is placed. The pedestal carries a plunger insertable through a hole in the top of the housing.

Thus, the plunger is located partly within the housing and able to interact with the dynamometer.

Conventional units of the type outlined above are washed down periodically in order to remove any residues of the liquid or powder products with which the containers are filled. In the course of filling operations, more exactly, part of the liquid or powder product can escape from the containers and drop onto the pedestal structure, onto the housing or onto the carousel.

At the end of a given production run, accordingly, nozzles are activated to direct a washing liquid onto the carousel, especially onto those areas where the residues are most heavily concentrated.

The washing process in question is a cause of major drawbacks however, due to the infiltration of washing liquid through the hole in the housing.

In effect, the dynamometer components include a piezoelectric material, and electronic parts that are easily damaged if brought into contact with a liquid.

Furthermore, carousels of the type described above are affected by a serious drawback linked to the structural complexity of the weighing means.

In effect, whenever the load cell of the dynamometer needs replacing or servicing, the entire housing first has to be removed from the carousel, whereupon the housing itself must be opened up in order to remove the dynamometer from the relative enclosure.

This servicing operation, normally a manual procedure, turns out to be particularly expensive and complicated, especially when considering the overall weight of the housing, coupled to the plunger and furnished internally with the load cell and all the electronic componentry of the weighing and filling system.

DISCLOSURE OF THE INVENTION

The object of the present invention, accordingly, is to provide a carousel for supporting and weighing containers that will be unaffected by the drawbacks mentioned above.

In particular, the object of the present invention is to provide a carousel for supporting and weighing containers, such as can undergo washing operations without being damaged.

Another object of the present invention is to set forth a carousel for supporting and weighing containers that is simple in construction and equipped with respective weighing means that are easily removed from the carousel.

The stated objects are realized in a carousel for supporting and weighing containers embodied according to the invention, which is characterized in that it comprises: a carrier element supporting at least one container, rotatable about a respective axis and presenting at least one opening affording access to an enclosure within the selfsame element; at least one plate associated with the carrier element, serving to close the opening; and means by which to weigh the container, associated with the plate and housed at least in part internally of the enclosure.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS OF THE INVENTION

Figure 1:
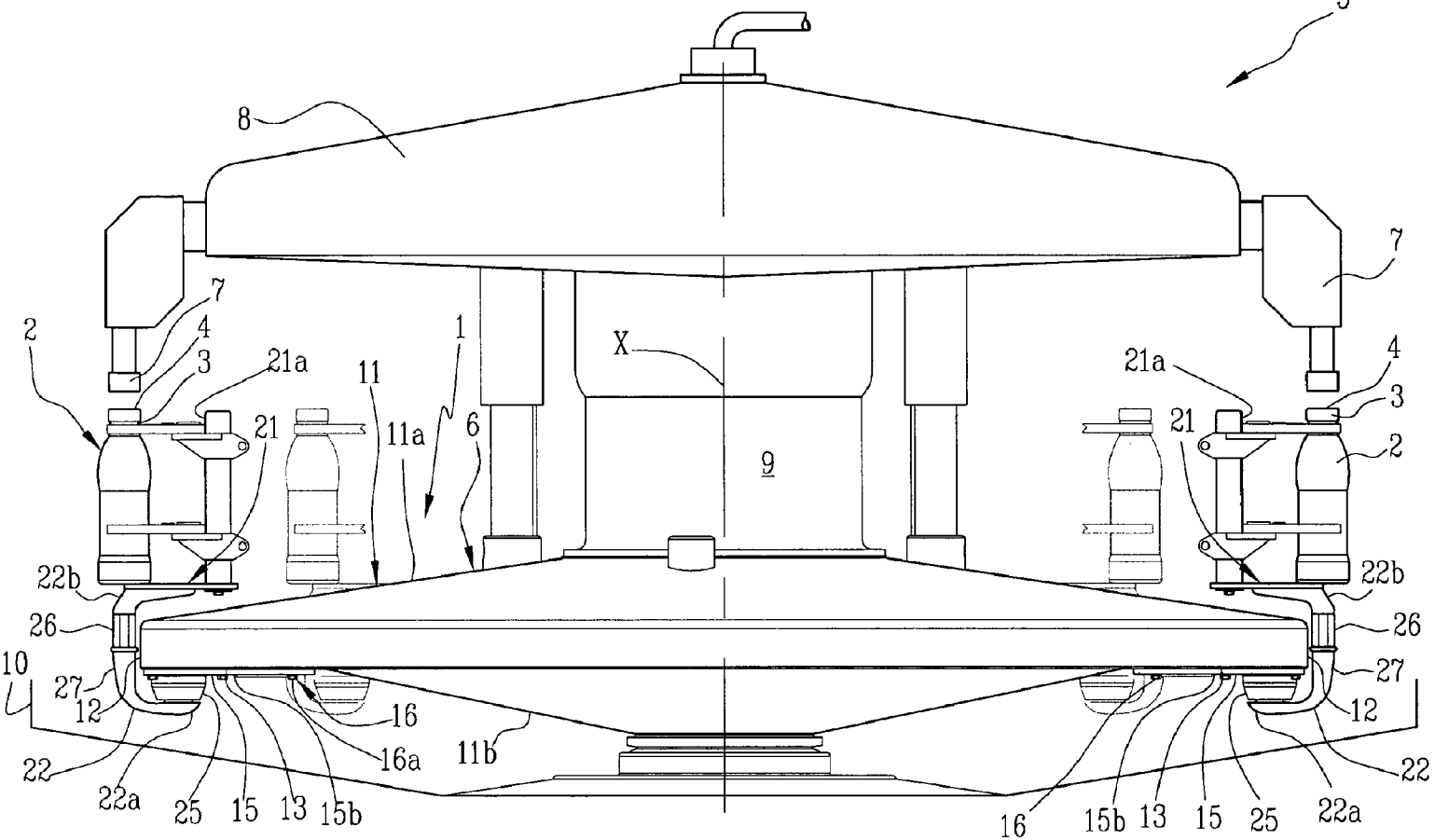
FIG. 1 shows a container filling unit equipped with the carousel for supporting and weighing containers according to the present invention, viewed in a side elevation.

With reference to FIG. 1, numeral 1 denotes a carousel, considered in its entirety, for supporting and weighing containers 2, each presenting a neck 3 with a filler mouth 4 such as can be closed by fitting a cap.

As discernible from FIG. 1, the carousel 1 finds application to advantage in filling units 5 of the type by which liquid or powder products are batched into containers 2 as described above.

In particular, and as illustrated schematically in FIG. 1, the carousel 1 constitutes a part of the filling unit 5 and is rotatable about a respective vertical axis X.

The carousel 1 consists of a carrier element 6 designed to support a plurality of containers 2, which are caused to advance along a predetermined circular path as the carousel rotates about the vertical axis X.

The filling unit 5 further comprises a plurality of dispensing elements 7, each located directly above a corresponding container 2 in such a way as to release a liquid or powder product into the selfsame container 2 beneath.

The dispensing elements 7 are mounted preferably to the periphery of a frame 8. Both the frame 8 and the carousel 1 are coupled to a shaft 9 of which the longitudinal dimension extends parallel to the aforementioned axis X of rotation. During the step of filling the containers 2, accordingly, the carousel 1 and the frame 8 are caused to rotate as one about the vertical axis X.

Likewise preferably, the filling unit 5 comprises a collection tank 10 located beneath the carousel 1 and serving to catch the washing liquid falling from the carousel 1 and the frame 8.

Thus, when cleaning operations are carried out on the unit 5 as a whole, the washing liquid will run off the outer surfaces of the frame 8 and the carousel 1, and drain into the tank 10.

Figure 2:
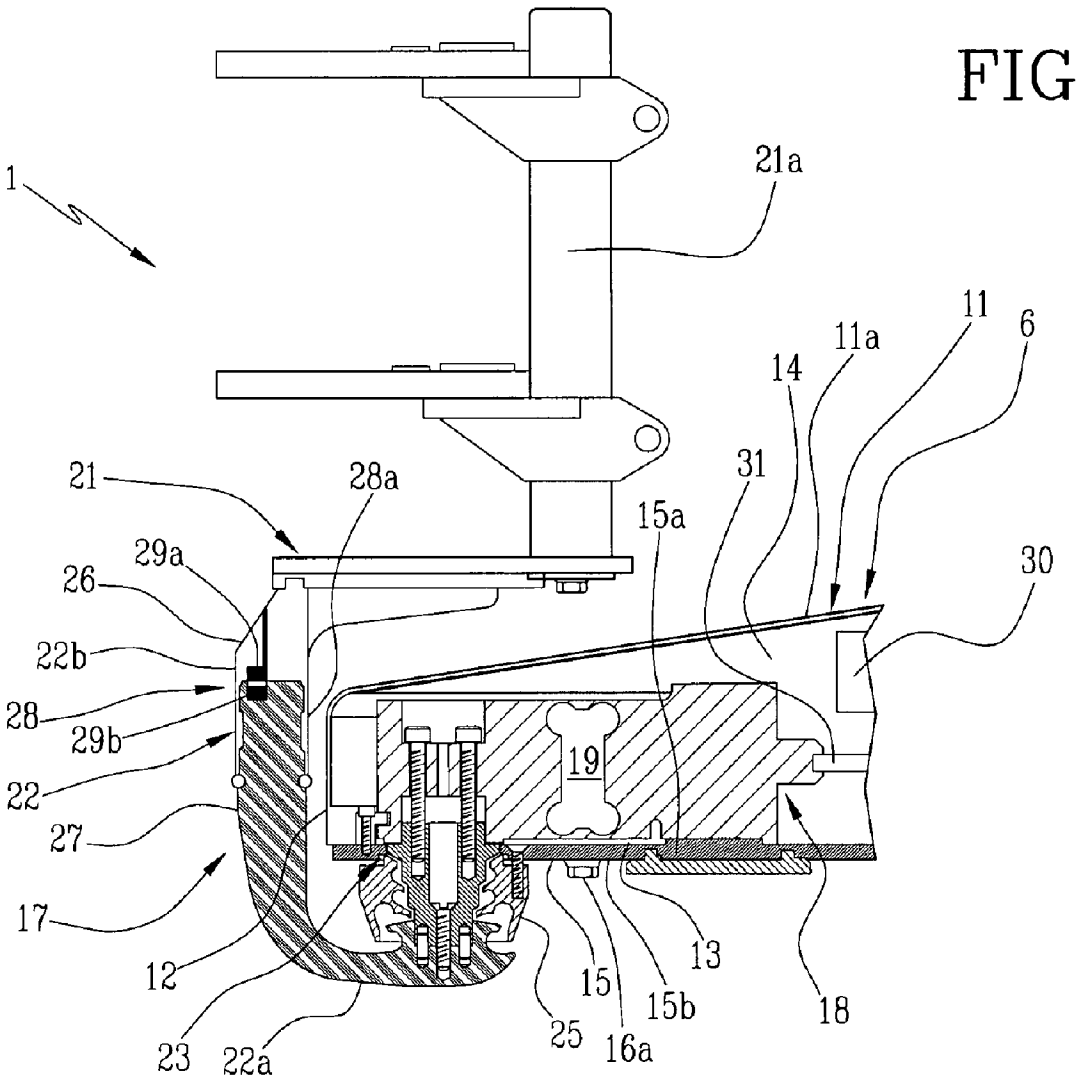
FIG. 2 shows a portion of the carousel in FIG. 1, illustrated in a side elevation and in section.

As illustrated to advantage in FIG. 2, the carrier element 6 appears as a disc 11 of substantially circular peripheral outline, presenting a top surface 11*a* that functions as a cover, and a bottom surface 11*b* lying opposite to the top surface 11*a*. The top surface 11*a* is angled downward away from an area adjacent to the aforementioned shaft 9 toward a peripheral rim 12 of the carrier element 6. The bottom surface 11*b* presents a substantially flat portion adjacent to the rim 12 and a portion angled downward from the flat portion toward an area adjacent to the shaft 9.

The bottom surface 11*b* also presents a plurality of openings 13, each formed in the aforementioned flat portion and spaced apart at a convenient distance one from the next around the entire circumferential length of the carrier element 6.

As illustrated to advantage in FIG. 2, each opening 13 affords a point of access to the interior of an enclosure 14 created within the carrier element 6 between the top surface 11*a* and the bottom surface 11*b*.

Each opening 13 is also furnished with a plate 15, associated removably with the bottom surface 11*b* in such a way as to close the relative opening 13.

Figure 3:
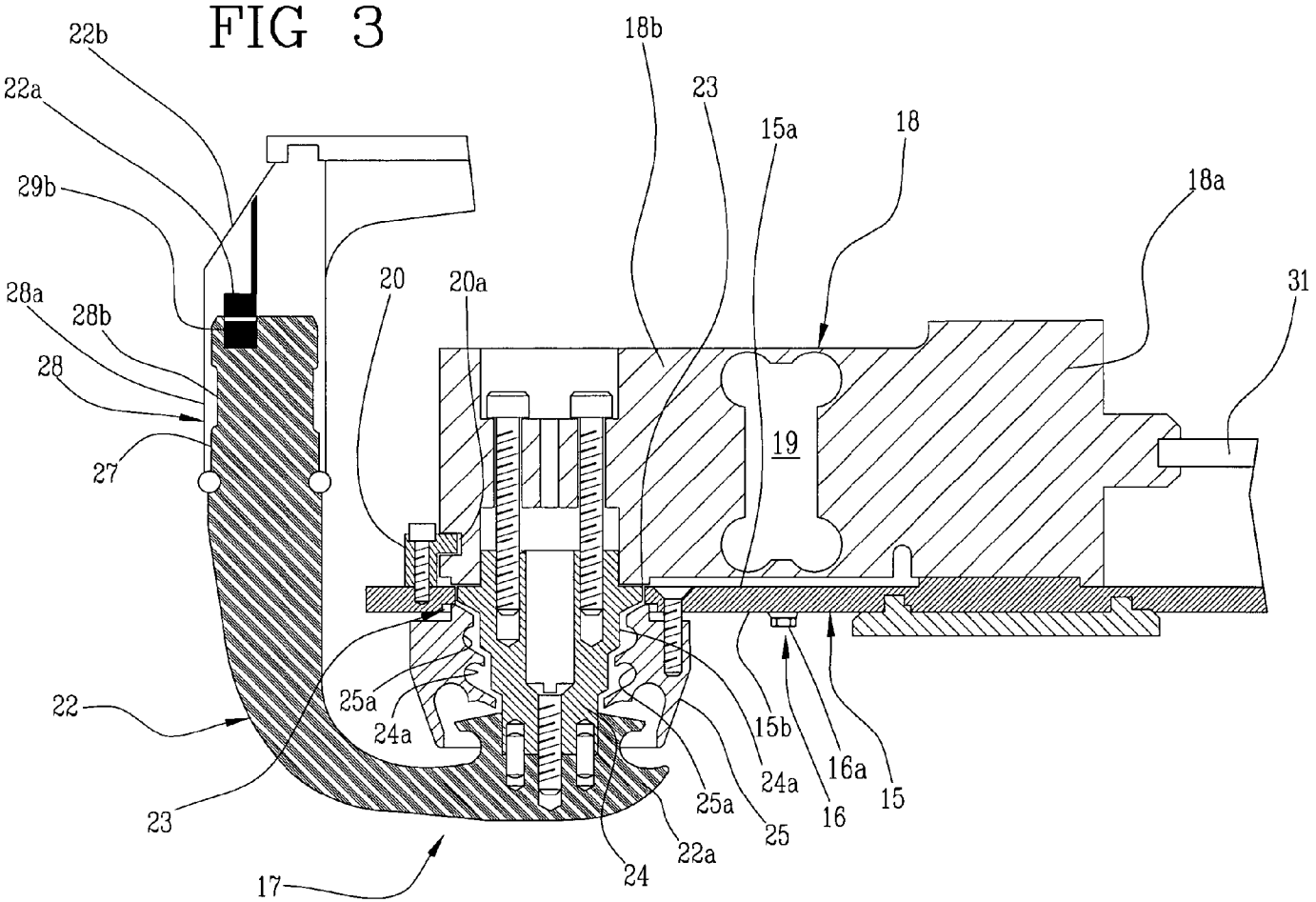
FIG. 3 shows a constructional detail of the carousel in FIG. 1, illustrated in a side elevation and in section.

In particular, and as shown in the detail illustration of FIG. 3, each plate 15 presents an inner surface 15*a* directed toward the carrier element 6 and an outer surface 15*b* directed toward the collection tank 10 (FIG. 1). The plate 15 is provided with separable fastening means 16 such as will allow it to be attached to or detached from the bottom surface 11*b* of the carrier element 6.

In a preferred solution, the separable fastening means 16 will consist in a set of screws 16*a* engaging in holes passing through the plate 15 and the bottom surface 11*b*.

Thus, by fastening and unfastening the screws 16*a*, the single plate 15 can be retained in a first condition, associated with and occluding the relative opening 13, and released so as to assume a second condition in which it is detached from the selfsame opening 13.

The carousel 1 further comprises means 17 by which to weigh the containers 2, associated with the plate 15 and housed at least partially in the aforementioned enclosure 14.

In particular, the weighing means 17 comprise a plurality of load cells 18 housed internally of the enclosure 14, each one of which coupled to a respective plate 15.

The single load cell 18, which is of substantially rectangular parallelepiped appearance, comprises a rigid portion denoted 18*a*, anchored to the inner surface 15*a* of the plate 15, and a movable portion denoted 18*b*, cantilevered from the rigid portion 18*a*.

When the plate 15 is detached from the bottom surface 11*b*, self-evidently, the opening 13 affords access to the inside of the enclosure 14. In this situation, the load cell 18 can be removed from the enclosure 14 for the purposes of servicing or replacement.

Also, the load cell 18 presents a cavity 19 between the rigid portion 18*a* and the movable portion 18*b*, which serves to enhance the flexible response of the component as will be explained more fully in due course.

Advantageously, the enclosure 14 also houses a stop 20 accommodated partially in a recess 20*a* afforded by the movable portion 18*b* of the load cell 18. The function of the stop 20 is to ensure that the travel of the movable portion 18*b* remains within a safe limit when the load cell 18 is flexed. Consequently, there will be no risk of damage to the load cell 18 caused by excessive flexural displacement of the movable portion 18*b*.

The weighing means 17 further comprise a plurality of pedestals 21 arranged around the top surface 11*a*, on which to stand respective containers 2. Each pedestal 21 is positioned facing a respective dispensing element 7 and supports the container 2 throughout the filling operation.

Each pedestal 21 can also be equipped with a vertical restraint 21*a* designed to latch onto the container 2 (FIG. 1) and ensure that it will not be flung away from the pedestal 21 during the rotation of the carousel 1.

In addition, each pedestal 21 is associated with a respective load cell 18 by way of a connecting element 22 that appears as an arm substantially of C profile, extending at least in part around the peripheral rim 12 of the carrier element 6 (FIG. 1).

The connecting element 22 presents a first end 22*a* associated with the load cell 18 and a second end associated with the respective pedestal 21.

As illustrated to advantage in FIG. 2 and in FIG. 3, each plate 15 presents a hole 23 admitting the first end 22*a* of the connecting element 22 to the inside of the enclosure 14. It will be seen that with this arrangement, the connecting element 22 is accommodated partly within the enclosure 14 and connectable to the movable portion 18*b* of the load cell 18.

It will be seen also that the first end 22*a* of the connecting element 22 presents a cylinder 24, anchored by way of suitable coupling means to the load cell 18, which passes through a sealing boot 25 associated with the respective plate 15 and designed to ensure that washing liquid directed onto the carrier element 6 will not find its way into the enclosure 14.

More exactly, the boot 25 is fitted to the hole 23 afforded by the plate 15 and presents a hollow interior allowing the passage of the cylinder 24 into the enclosure 14.

Moreover, and as illustrated to advantage in FIG. 3, the hollow interior of the boot 25 presents a series of mutually coaxial recesses 25*a* directed toward respective annular portions 24*a* of the cylinder 24. The annular portions 24*a* decrease in diameter the farther they are distanced from the load cell 18 and combine with the aforementioned recesses 25*a* to create a labyrinth seal by which any washing liquid directed at the area around the boot 25 is prevented from reaching and passing through the hole 23.

In effect, whenever the washing liquid begins to infiltrate the boot 25, the recesses 25*a* function as respective pockets able to retain the liquid. In addition, the annular portions 24*a* are angled downward in such a way that any liquid will run off the cylinder and out of the boot 25.

The second end 22*b* of the connecting element 22 presents a first portion 26 permanently associated with the relative pedestal 21, and a second portion 27 integral with the first end 22*a*. The portions 26 and 27 are interconnected by means of a separable coupling element 28, and consequently attachable to and detachable from one another.

In greater detail, the fastener element 28 presents a tubular portion 28*a* associated with the first portion 26 and mountable over a projection 28*b* of the second portion 27 (FIG. 3).

Moreover, located internally of the tubular portion 28*a* is a first magnet 29*a* attractable to a second magnet 29*b* presented by the aforementioned projection 28*b*.

Advantageously, the first portion 26 remains associated with the second portion 27 due to the force of attraction between the two magnets 29*a* and 29*b*. In the event that the pedestal 21 needs to be replaced, the first portion 26 can be separated from the second portion 27 by detaching the tubular portion 28*a* from the projection 28*b*.

Furthermore, the tubular portion 28*a* is proportioned in such a way as to fail mechanically when the weight of the container 2 placed on the respective pedestal 21 registers at a given value.

In short, the thickness of the tubular portion 28*a* and the material from which it is fashioned will be such as to induce deformation and subsequent rupture in the event of the container 2 taking on excessive weight. When the tubular portion 28*a* is damaged in this way, the second portion 27 will be replaced as described previously. The load cell 18 can therefore be protected from excessive flexural movement caused by excess weight of the container 2.

To advantage, the carrier element 6 also houses a delivery system 30, not described or illustrated in detail, by means of which to release air under pressure into the enclosure 14.

Accordingly, the overpressure will prevent any ingress into the enclosure 14 of a washing liquid directed onto the carousel 1.

In addition, the weighing means 17 comprise an electronic connecting component 31, housed in the enclosure 14 and designed to send an electrical signal to a control unit.

In particular, the electrical signal is generated by the component 31 to indicate the weight of the container 2, as represented by the extent to which the movable portion 18*b* of the load cell flexes in relation to the rigid portion 18*a*, and relayed to the aforementioned control unit (not described or illustrated in detail), which will be housed preferably in the filling unit 5.

Thus, as the container 2 fills, the connecting element 22 moves downwards and induces a corresponding downward displacement of the cylinder 24. The movable portion 18*b* of the load cell 18 consequently flexes downward, generating the aforementioned electrical signal to indicate to the weight of the container 2.

Advantageously, a liquid directed onto the overall structure of the carousel 1 runs down the carrier element 6 toward the collection tank 10 of the unit 5 (FIG. 1). The liquid will therefore not linger on any exposed surface of the carousel 1 and cannot drop into the enclosure 14 created within the carrier element 6. Accordingly, the load cell 18 is protected from any ingress of liquid that could otherwise occur.

The presence of pressurized air inside the enclosure 14 also ensures that liquids are kept out, even when penetrating to the point of infiltration.

Finally, the carousel 1 is structurally simple, and therefore unaffected by high costs.

In effect, when operations involving maintenance or replacement of the weighing means 17 become necessary, these can be performed by removing the plate 15 from the bottom surface 11*b* of the carrier element.

The load cell 18 can then be removed and replaced or serviced without difficulty. Advantageously, the operation in question requires no dismantling of complex and heavy mechanical components forming part of the carousel 1.

What is claimed is:

1. A carousel for supporting and weighing containers, comprising:

a carrier element supporting at least one container, rotatable about a respective axis and including at least one opening affording access to an enclosure within the carrier element, the carrier element comprising a disc having a top surface that functions as a cover, and a bottom surface having a plurality of openings;

a plurality of plates associated with the plurality of openings, each plate for closing a respective one of the openings, and a weighing mechanism for weighing means the container, associated with each plate, and housed at least partially internally of the enclosure.

2. A carousel as in claim 1, wherein the weighing mechanism comprises a plurality of load cells housed in the enclosure and attached to the plurality of plates, one load cell per plate.

3. A carousel as in claim 2, further comprising a separable fastening mechanism for attaching and detaching each plate to and from the bottom surface of the carrier element, establishing a first condition in which the plate is associated with the opening and the load cell housed internally of the enclosure, and a second condition in which the plate is detached from the opening and the load cell removed from the enclosure.

4. A carousel as in claim 2, wherein the weighing mechanism further comprises a plurality of pedestals arranged around the top surface, on which to stand respective containers, and a plurality of connecting elements each having a first end associated with the load cell, and a second end associated with the respective pedestal; each plate fashioned with a hole allowing passage of the first end of the respective connecting element into the enclosure.

5. A carousel as in claim 4, wherein each connecting element includes an arm substantially of C-shaped profile extending around a peripheral rim of the carrier element.

6. A carousel as in claim 4, further comprising a sealing boot associated with the plate at the respective hole and constructed and arranged to ensure that a washing liquid directed onto the carrier element will not infiltrate the enclosure.

7. A carousel as in claim 4, wherein the load cell includes a rigid portion anchored to an inner surface of the plate, and a movable portion, cantilevered from the rigid portion and anchored to the second end of the connecting element.

8. A carousel as in claim 4, wherein the second end of each connecting element comprises a first portion permanently associated with the respective pedestal and a second portion integral with the first end, and the connecting element also includes a separable coupling element for attaching and detaching the first portion and the second portion to and from one another.

9. A carousel as in claim 8, wherein the coupling element comprises a tubular portion associated with the first portion, mountable over a projection of the second portion, and damageable under a predetermined weight of the container standing on the respective pedestal.

10. A carousel as in claim 4, further comprising a delivery system housed internally of the carrier element, by which air is released under pressure into the enclosure.

* * * * *